US008037970B2

(12) United States Patent
Sato

(10) Patent No.: US 8,037,970 B2
(45) Date of Patent: Oct. 18, 2011

(54) CHECKOUT COUNTER AND SELF CHECKOUT TERMINAL

(75) Inventor: Shigeru Sato, Kanagawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 155 days.

(21) Appl. No.: 12/469,725

(22) Filed: May 21, 2009

(65) Prior Publication Data

US 2009/0288917 A1 Nov. 26, 2009

(30) Foreign Application Priority Data

May 22, 2008 (JP) ..... 2008-134856

(51) Int. Cl.
*A63F 9/02* (2006.01)

(52) U.S. Cl. ..... 186/62; 186/59

(58) Field of Classification Search ..... 186/60–66, 186/47, 50, 51, 59, 67–69; 700/213–215; 235/383
See application file for complete search history.

(56) References Cited

U.S. PATENT DOCUMENTS

| | | | | |
|---|---|---|---|---|
| 3,196,984 | A * | 7/1965 | Stout | 186/65 |
| 6,776,333 | B2 * | 8/2004 | Matsushita | 235/383 |
| 7,242,300 | B1 * | 7/2007 | Konstad et al. | 340/568.5 |
| 2006/0164208 | A1 * | 7/2006 | Schaffzin et al. | 340/5.64 |
| 2006/0244588 | A1 * | 11/2006 | Hannah et al. | 340/539.13 |
| 2008/0217112 | A1 * | 9/2008 | Puskala et al. | 187/392 |

FOREIGN PATENT DOCUMENTS

JP 2005-209089 8/2005

* cited by examiner

*Primary Examiner* — Jeffrey Shapiro
(74) *Attorney, Agent, or Firm* — Turocy & Watson, LLP

(57) ABSTRACT

A counter base for checkout includes a basket placing table on one side thereof to be freely raised and lowered. A driving unit can drive to raise and lower the basket placing table. A first detecting unit detects that a shopping cart enters an access area closer to the basket placing table than a predetermined range. A second detecting unit detects presence or absence of the shopping cart stopped along one side of the counter base. A control unit controls to drive, when the first detecting unit detects entrance of the shopping cart into the access area, the driving unit to move the basket placing table to a lowered position and, thereafter, controls to drive, when the second detecting unit does not detect the shopping cart stopped along the counter base, the driving unit to return the basket placing table to a raised position.

16 Claims, 15 Drawing Sheets

CHECKOUT COUNTER AND SELF CHECKOUT TERMINAL

CROSS REFERENCE TO RELATED APPLICATION

This application is based upon and claims the benefit of priority from Japanese Patent Application No. P2008-134856, filed on May, 22, 2008, the content of which is incorporated herein by reference.

TECHNICAL FIELD

The present invention relates to a checkout counter that supports checkout work for commodities purchased by a customer and a self checkout terminal with which the customer himself or herself carries out checkout for the commodities purchased by the customer, and, more particularly to a checkout counter and a self checkout terminal including a basket placing table for setting a shopping basket that stores commodities.

BACKGROUND

Conventionally, in various stores such as a supermarket and a drug store, checkout counters are set in checkout processing areas. Each of the checkout counters includes a barcode reader for reading commodity codes attached to commodities, which are stored in a shopping basket and carried to the checkout processing area, in a form of a barcode. The barcode reader transmits the read commodity codes to a POS terminal set near the checkout counter. The POS terminal performs checkout processing on the basis of the received commodity codes. In such commodity sales, in general, a customer places a shopping basket, which stores commodities, on one side of the barcode reader on the checkout counter. A store clerk takes out the commodities from the shopping basket, reads commodity codes of the commodities with the barcode reader, and stores the commodities after the reading of the commodity codes in an empty shopping basket placed on the other side of the barcode reader. The checkout counter is formed large to some extent in order to carry out work in such a work procedure.

The large checkout counter is not suitable for setting in a small store such as a drug store. In the first place, the small store may not have a space for setting the large checkout counter. Even if the large checkout counter can be set, the large checkout counter may improperly occupy a store space or cause customers to feel a strong sense of oppression. Therefore, mainly taking into account the use in such a small store, a checkout counter in which a basket placing table for setting a shopping basket, which stores commodities, is provided on a side of a counter base formed in a small size is developed and put to practical use. For example, JP-A-2005-209089 discloses a checkout counter in which a basket placing table is arranged on a side of a counter base on which a barcode reader is set. The checkout counter can slide and draw the basket placing table to below a top plate of the counter base and open a setting space for the basket placing table.

A store often includes shopping carts in addition to shopping baskets. A shopping cart is extremely convenient for a customer to carry, when the customer purchases many commodities that the shopping basket cannot store, the commodities from a selling floor to the checkout counter. However, when the customer uses the shopping cart, the customer has to move a shopping basket from the shopping cart to the counter.

This work is unexpectedly heavy because the customer has to vertically lift the shopping basket filled with commodities from the shopping cart. Therefore, the work for moving the shopping basket from the shopping cart to the counter imposes an excessive burden on, in particular, a customer with little power like an aged person.

On the other hand, in the checkout counter disclosed in JP-A-2005-209089, if the basket placing table is drawn to below the top plate of the counter base, the customer can stop the shopping cart along the side of the counter base. This allows the customer to omit the work for moving the shopping basket from the shopping cart to the counter. However, when commodities are carried to the checkout counter, the shopping basket is directly carried to the checkout counter in some case and is carried to the checkout counter by the shopping cart in other cases. Therefore, the store clerk has to expose the basket placing table when the shopping basket is directly carried to the checkout counter and draw the basket placing table to below the top plate when the shopping basket is carried by the shopping cart. The work is extremely troublesome and the store clerk cannot withstand the troublesomeness.

SUMMARY

It is an object of the present invention to make it possible to switch, without imposing a burden on a store clerk, a form of use for placing a shopping basket on a counter and a form of use for stopping a shopping cart along a counter base.

According to an aspect of the present invention, there is provided a checkout counter including: a counter base for checkout; a basket placing table that is provided on one side of the counter base, has on an upper surface thereof a placing surface for placing a shopping basket, and is freely raised and lowered between a raised position suitable for placing the shopping basket and a lowered position where the basket placing table does not interfere with a shopping cart stopped along one side of the counter base; and a control unit that moves the basket placing table to the lowered position when entrance of the shopping cart into an access area is detected and, thereafter, returns the basket placing table to the raised position when the shopping cart stopped along the counter base is not detected.

According to another aspect of the present invention, there is provided a checkout counter including: a counter base for checkout; a basket placing table that is provided on one side of the counter base, has on an upper surface thereof a placing surface for placing a shopping basket, and is freely raised and lowered between a raised position suitable for placing the shopping basket and a lowered position where the basket placing table does not interfere with a shopping cart stopped along one side of the counter base; and a control unit that moves the basket placing table to the raised position when placement of the shopping basket on the placing surface is detected and, thereafter, returns the basket placing table to the lowered position when the placement of the shopping basket on the placing surface is not detected.

According to still another aspect of the present invention, there is provided a self checkout terminal including: a terminal base that enables a customer to perform self checkout using a user interface provided in a housing; a basket placing table that is provided on one side of the housing, has on an upper surface thereof a placing surface for placing a shopping basket, and is freely raised and lowered between a raised position suitable for placing the shopping basket and a lowered position where the basket placing table does not interfere with a shopping cart stopped along one side of the housing;

and a control unit that moves the basket placing table to the lowered position when entrance of the shopping cart into an access area is detected and, thereafter, returns the basket placing table to the raised position when the shopping cart stopped along the housing is not detected.

According to still another aspect of the present invention, there is provided a self checkout terminal including: a terminal base that enables a customer to perform self checkout using a user interface provided in a housing; a basket placing table that is provided on one side of the housing, has on an upper surface thereof a placing surface for placing a shopping basket, and is freely raised and lowered between a raised position suitable for placing the shopping basket and a lowered position where the basket placing table does not interfere with a shopping cart stopped along one side of the housing; and a control unit that moves the basket placing table to the raised position when placement of the shopping basket on the placing surface is detected and, thereafter, returns the basket placing table to the lowered position when the placement of the shopping basket on the placing surface is not detected.

DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION

An embodiment of the present invention is explained with reference to FIGS. 1 to 15. This embodiment is an example of application of the present invention to a checkout counter 101 set in a checkout processing area.

Figure 1:
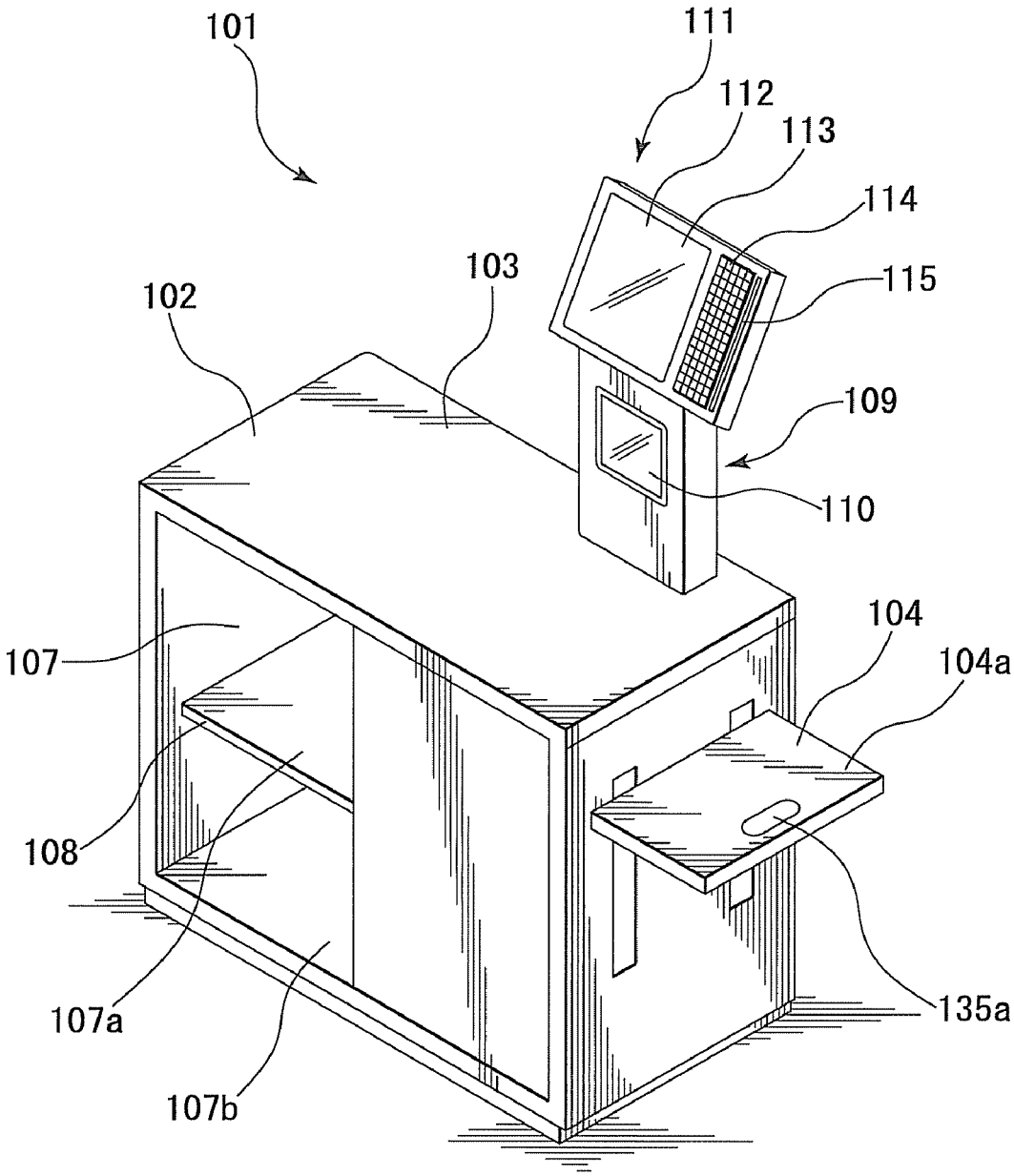
FIG. 1 is a perspective view of a checkout counter according to an embodiment of the present invention.

As shown in FIG. 1, the checkout counter 101 includes a counter base 103 having a counter top plate 102 for checkout. The counter base 103 includes a basket placing table 104 on one side thereof. The basket placing table 104 includes a placing surface 104*a*, on an upper surface of which a shopping basket SB (see FIG. 2) can be placed. The basket placing table 104 is freely raised and lowered and is driven to be raised and lowered by a driving unit 105 explained later (see FIGS. 6 to 13). The counter base 103 incorporates, on a side on which the basket placing table 104 is provided, a raising and lowering mechanism 106 (see FIGS. 4 and 5) and the driving unit 105 for the basket placing table 104 and includes a housing section 107 in a position adjacent to the raising and lowering mechanism 106 and the driving unit 105. The housing section 107 is partitioned into an upper space 107*a* and a lower space 107*b* by a shelf board 108. The housing section 107 can house, for example, various consumables used in checkout processing.

On the counter top plate 102 of the counter base 103, a barcode reader 109 is set on an inner side thereof closer to the side of the basket placing table 104. The barcode reader 109 is a vertical scanner including a scan window 110 directed in the vertical direction. An operation display unit 111 is fixed to an upper part of the barcode reader 109. The operation display unit 111 includes a liquid crystal display 113, on the surface of which a touch panel 112 is stacked and arranged. The operation display unit 111 includes a keyboard 114 of a membrane type on the right of the liquid crystal display 113 and includes a card scan groove 115 on the right of the keyboard 114.

Figure 2:
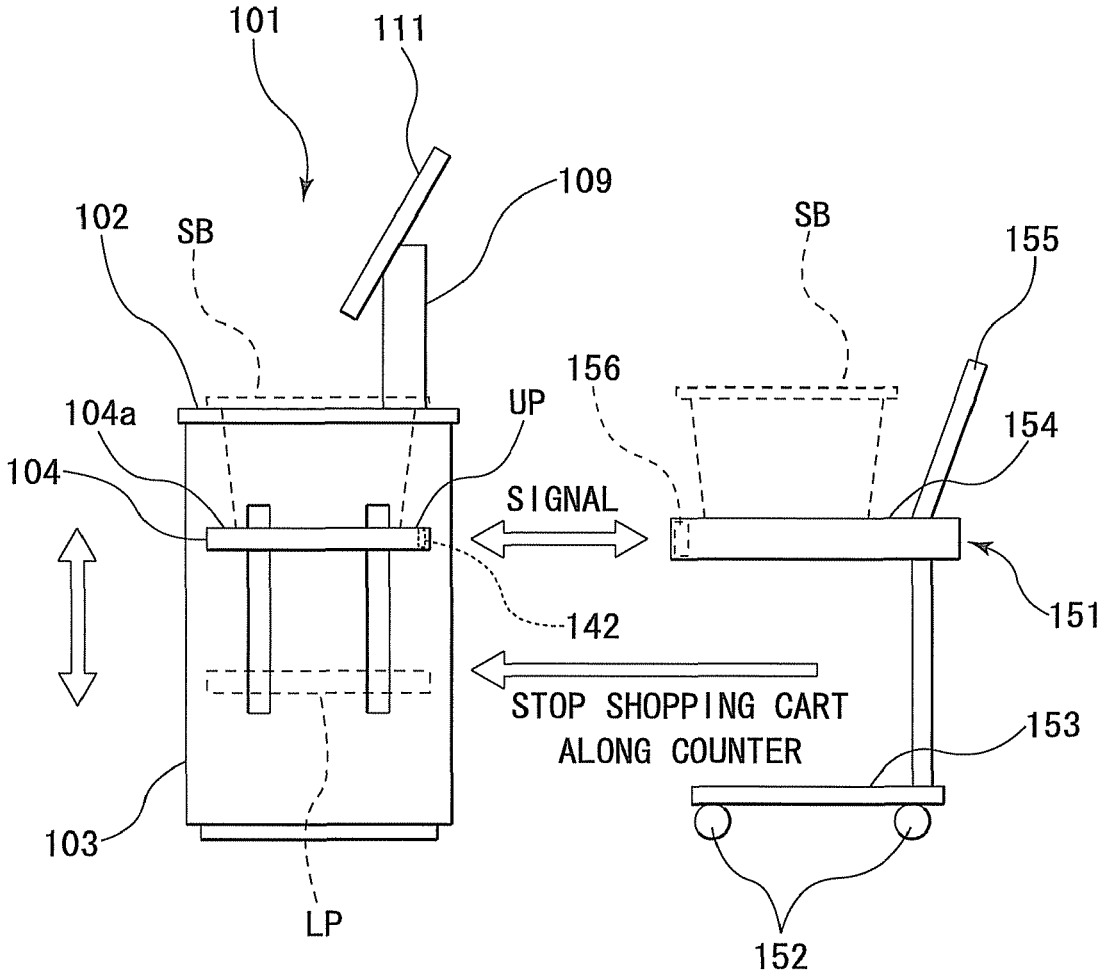
FIG. 2 is a schematic diagram of raising and lowering operation for a basket placing table performed in the checkout counter when a shopping cart approaches the checkout counter.

FIG. 2 is a schematic diagram of raising and lowering operation for the basket placing table 104 performed in the checkout counter 101 when a shopping cart 151 approaches the checkout counter 101. As explained above, the basket placing table 104 is freely raised and lowered. In FIG. 2, a position of the basket placing table 104 indicated by a solid line is a raised position UP and a position of the basket placing table 104 indicated by a broken line is a lowered position LP. In this embodiment, in a normal state, the basket placing table 104 is located in the raised position UP. When the shopping basket SB is placed on the placing surface 104*a* of the basket placing table 104 in the normal state, an upper surface of the shopping basket SB substantially coincides with a height position of the counter top plate 102 of the counter base 103. Therefore, the raised position UP is a position suitable for placing the shopping basket SB where commodities (not shown in the figure) are easily taken out from the shopping basket SB placed on the placing surface 104*a* of the basket placing table 104.

The shopping cart 151 includes four casters 152 at four corners in a lower part and includes a handle 155 in an upper part. The casters 152 allow a customer to freely move the shopping cart 151 holding the handle 155. The shopping cart 151 includes a lower stage placing section 153 that is a lower side placing section for the shopping basket SB and includes an upper stage placing section 154 that is an upper side placing section for the shopping basket SB. A height position of the upper stage placing section 154 substantially coincides with a height position of the basket placing table 104 of the checkout counter 101. Therefore, when the customer attempts to stop the shopping cart 151 along the side of the checkout counter 101 on which the basket placing table 104 is arranged, the upper stage placing section 154 of the shopping cart 151 interferes with the basket placing table 104 of the checkout counter 101.

Therefore, in this embodiment, the checkout counter 101 detects that the shopping cart 151 enters an access area closer to the basket placing table 104 than a predetermined range. When the shopping cart 151 enters the access area, the checkout counter 101 retracts the basket placing table 104 to the lowered position LP. The lowered position LP is a position where the basket placing table 104 does not interfere with the shopping cart 151 stopped along one side of the counter base 103. This makes it possible to prevent interference of the upper stage placing section 154 of the shopping cart 151 with the basket placing table 104 of the checkout counter 101 and stop the shopping cart 151 along the side on which the basket placing table 104 of the checkout counter 101 is arranged. After retracting the basket placing table 104 to the lowered position LP, the checkout counter 101 detects presence or absence of the shopping cart 151 stopped along the side of the checkout counter 101. When the shopping cart 151 stopped along the side of the shopping cart 151 is not detected, the checkout counter 101 returns the basket placing table 104 to the raised position UP. Consequently, the checkout counter 101 can make it easy to take out commodities (not shown in the figure) from the shopping basket SB placed on the placing surface 104*a* of the basket placing table 104.

The structure, actions and functions, and the like for enabling the basket placing table 104 to operate are explained in detail below.

Figure 3:
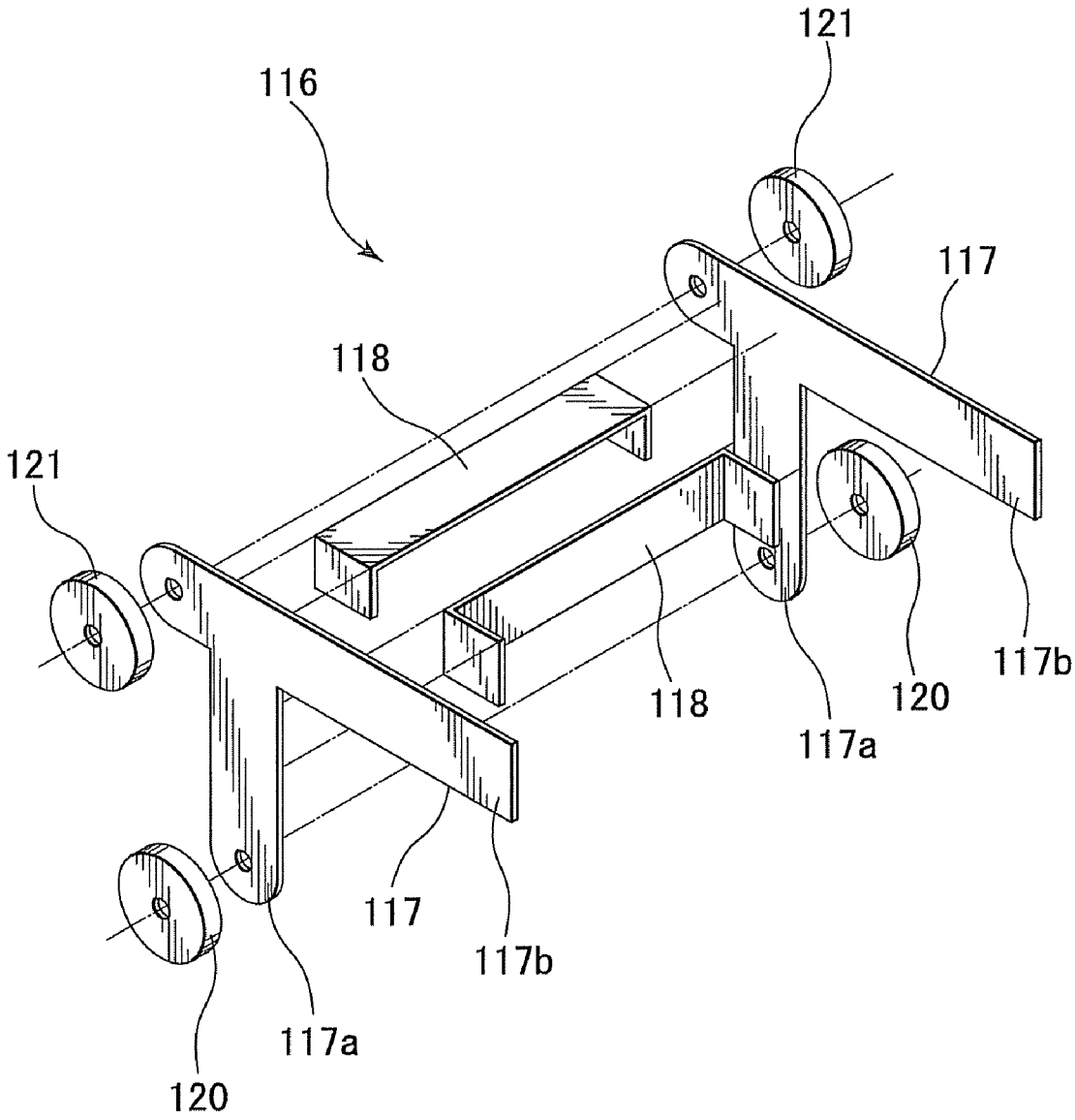
FIG. 3 is a disassembled perspective view of a frame of the basket placing table.

FIG. 3 is a disassembled perspective view of a frame 116 of the basket placing table 104. In the frame 116, a pair of L-shaped frame bases 117 are coupled by two supporting members 118. The frame bases 117 and the supporting members 118 are sheet metals coupled by welding. The pair of frame bases 117 include vertical pieces 117*a* and horizontal pieces 117*b*. The pair of horizontal pieces 117*b* support an external component 119 (see FIG. 5) of the basket placing table 104.

In the pair of frame bases 117, a pair of lower rollers 120 as frictional wheels are rotatably attached to a lower section thereof and a pair of upper rollers 121 as frictional wheels are rotatably attached to an upper section thereof. The lower rollers 120 are located at lower ends of the vertical pieces 117*a* of the frame bases 117. The upper rollers 121 are located at rear ends of the horizontal pieces 117*b* of the frame bases 117. The rear ends of the horizontal pieces 117*b* are offset slightly to the rear side. Therefore, rotation center positions of the lower rollers 120 and the upper rollers 121 are shifted not to coincide with each other on the same vertical line (see FIG. 5).

Figure 4:
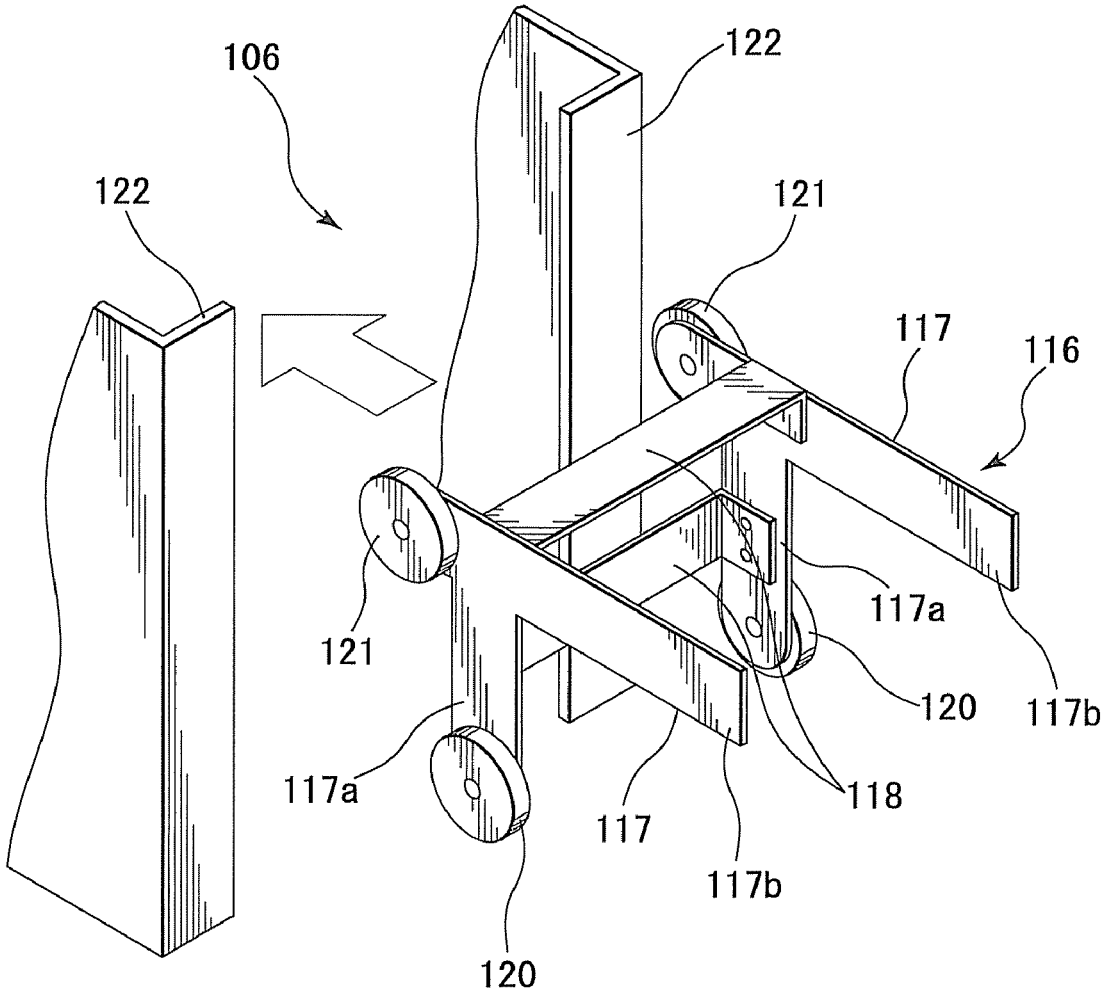
FIG. 4 is a disassembled perspective view of a raising and lowering mechanism for the basket placing table.

FIG. 4 is a disassembled perspective view of the raising and lowering mechanism 106 of the basket placing table 104. The checkout counter 101 includes a pair of rails 122 formed in an L shape in horizontal section. In the rails 122, the lower rollers 120 are arranged on the front side and the upper rollers 121 are arranged on the rear side to support the frame 116 of the basket placing table 104 to be freely raised and lowered. Therefore, the basket placing table 104 is freely raised and lowered relative to the counter base 103.

Figure 5:
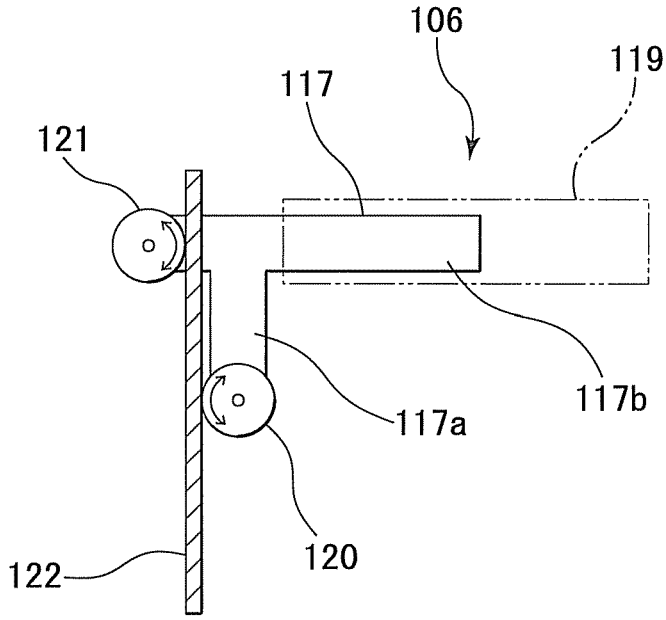
FIG. 5 is a side view of the raising and lowering mechanism for the basket placing table.

FIG. 5 is a side view of the raising and lowering mechanism 106 of the basket placing table 104. As shown in FIG. 5, the basket placing table 104 is heavy on a side (the right side in FIG. 5) on which the external component 119 is attached. In FIG. 5, the heavy side generates a moment pivoting downward. Consequently, both the lower roller 120 and the upper roller 121 strongly come into contact with the rails 122 to make it sure that the basket placing table 104 is supported by the rails 122.

When the basket placing table 104 is raised and lowered, the lower rollers 120 and the upper rollers 121 rotate according to the resistance to the rails 122. More specifically, in FIG. 5, when the basket placing table 104 is lowered, the lower rollers 120 rotate in the clockwise direction and the upper rollers 121 rotate in the counterclockwise direction. In FIG. 5, when the basket placing table 104 is raised, the lower rollers 120 rotate in the counterclockwise direction and the upper rollers 121 rotate in the clockwise direction.

Figure 6:
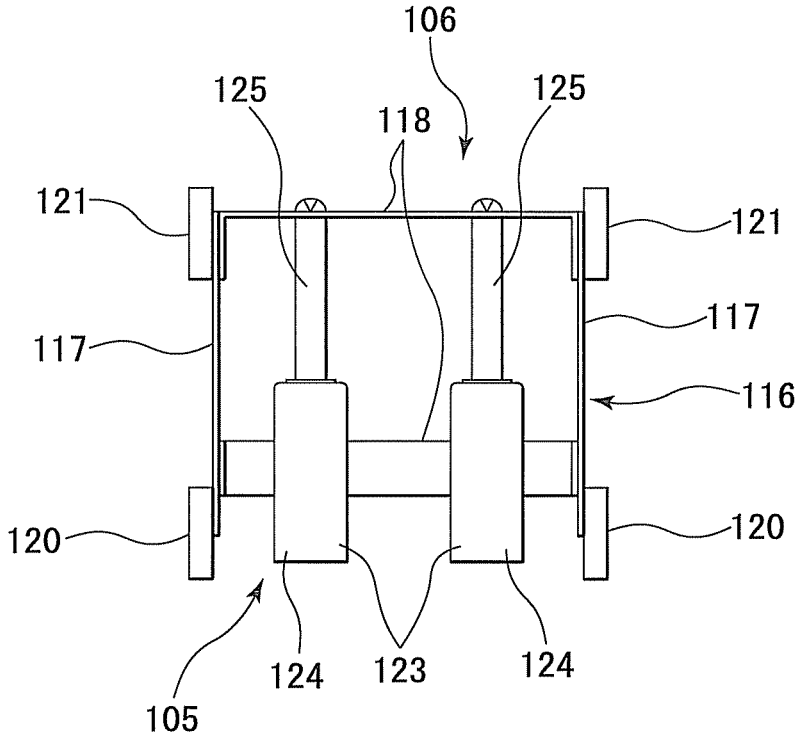
FIG. 6 is a front view of an example of a driving unit that drives to raise and lower the basket placing table.

FIG. 6 is a front view of an example of the driving unit 105 that drives to raise and lower the basket placing table 104. A first example of the driving unit 105 is shown in FIG. 6. In the first example, a hydraulic driving mechanism mainly including hydraulic cylinders 123 is used as the driving unit 105. The hydraulic driving mechanism includes a pair of hydraulic cylinders 123. Cylinders 124 of the respective hydraulic cylinders 123 are fixed to the side of the counter base 103. In the hydraulic cylinders 123, rods 125 retractable by the force of hydraulic pressure are housed in cylinders 124. The rods 125 are fixed to the supporting member 118 on the upper side that configures the frame 116 of the basket placing table 104. Therefore, the frame 116 of the basket placing table 104 is raised and lowered when the rods 125 are expanded and contracted by the force of the hydraulic pressure. Consequently, the basket placing table 104 is raised and lowered.

Figure 7:
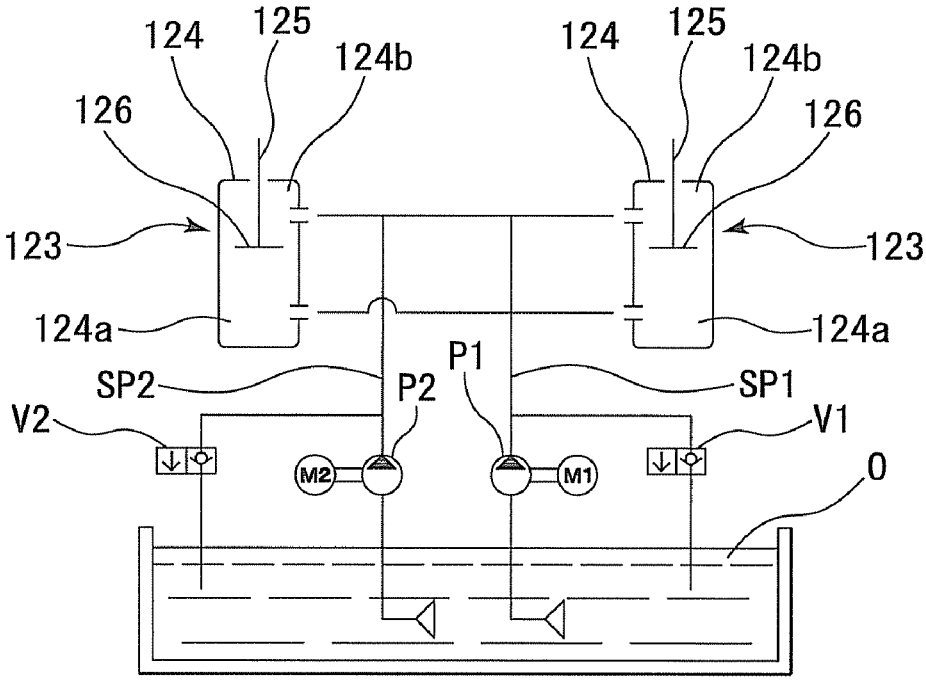
FIG. 7 is a circuit diagram of a hydraulic circuit of the driving unit shown in FIG. 6.

FIG. 7 is a circuit diagram of a hydraulic circuit of the driving unit 105 shown in FIG. 6. The cylinders 124 of the hydraulic cylinders 123 include lower chambers 124*a* and upper chambers 124*b*. The rods 125 include pistons 126 at ends thereof. The pistons 126 separate chambers in the cylinders 124 into the lower chambers 124*a* and the upper chambers 124*b*.

The driving unit 105 drives a motor M1 to drive a pump P1. The pump P1 supplies oil O to the lower chamber 124*a* of the cylinder 124. The pump P1 and the lower chambers 124*a* of the cylinder 124 are connected by a supply path SP1. The supply path SP1 includes an electromagnetic valve V1. When the electromagnetic valve V1 opens, the electromagnetic valve V1 can discharge the oil O escaping from the lower chambers 124*a* of the cylinder 124.

The driving unit 105 drives a motor M2 to drive a pump P2. The pump P2 supplies the oil O to the upper chambers 124*b* of the cylinders 124. The pump P2 and the upper chambers 124*b* of the cylinders 124 are connected by a supply path SP2. The supply path SP2 includes an electromagnetic valve V2. When the electromagnetic valve V2 opens, the electromagnetic valve V2 can discharge the oil O escaping from the upper chambers 124*b* of the cylinder 124.

In raising the frame 116, the driving unit 105 explained above drives to rotate the motor M1 and activate the pump P1 in a state in which the electromagnetic valve V1 is closed and the electromagnetic valve V2 is opened. When the pump P1 operates and feeds the oil O to the lower chambers 124*a* of the cylinders 124, the volume of the oil O in the lower chambers 124*a* increases, the capacity of the lower chambers 124*a* increases, and the pistons 126 start to move toward the upper chambers 124*b*. The oil O in the upper chambers 124*b* above the pistons 126 escapes through the supply path SP2 and the electromagnetic valve V2. When the capacity of the lower chambers 124*a* increases and the pistons 126 start to move toward the upper chambers 124*b*, the driving unit 105 drives the rods 125 in a projecting direction.

Conversely, in lowering the frame 116, the driving unit 105 drives to rotate the motor M2 and activate the pump P2 in a state in which the electromagnetic valve V2 is closed and the electromagnetic valve V1 is opened. When the pump P2 operates and feeds the oil O to the upper chambers 124*b* of the cylinders 124, the volume of the oil O in the upper chambers 124*b* increases, the capacity of the upper chambers 124*b* increases, and the pistons 126 start to move toward the lower chambers 124*a*. The oil O in the lower chambers 124*a* below the pistons 126 escapes through the supply path SP1 and the electromagnetic valve V1. When the capacity of the upper chambers 124*b* increases and the pistons 126 start to move toward the lower chambers 124*a*, the driving unit 105 drives the rods 125 in the retracting direction. In this way, the driving unit 105 can raise and lower the frame 116 coupled to the rods 125 and raise and lower the basket placing table 104.

Figure 8:
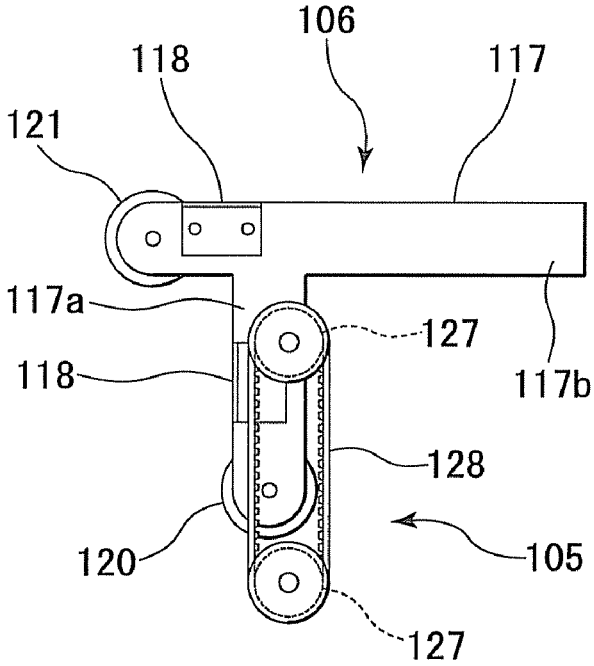
FIG. 8 is a longitudinal sectional side view of another example of the driving unit that drives to raise and lower the basket placing table.

FIG. 8 is a longitudinal sectional side view of another example of the driving unit 105 that drives to raise and lower the basket placing table 104. A second example of the driving unit 105 is shown in FIG. 8. In the second example, a belt driving mechanism having a motor M (see FIG. 9) as a driving source is used as the driving unit 105. The belt driving mechanism includes a pair of toothed rollers 127 rotatably attached to the side of the counter base 103 and a timing belt 128 laid over the toothed rollers 127. The pair of toothed rollers 127 are vertically located. Therefore, the timing belt 128 turns in an up to down direction. A part of such a timing belt 128 is fixed to the supporting member 118 on the lower side that configures the frame 116 of the basket placing table 104. Therefore, the driving unit 105 rotates the timing belt 128 to raise and lower the frame 116. This makes it possible to raise and lower the basket placing table 104.

Figure 9:
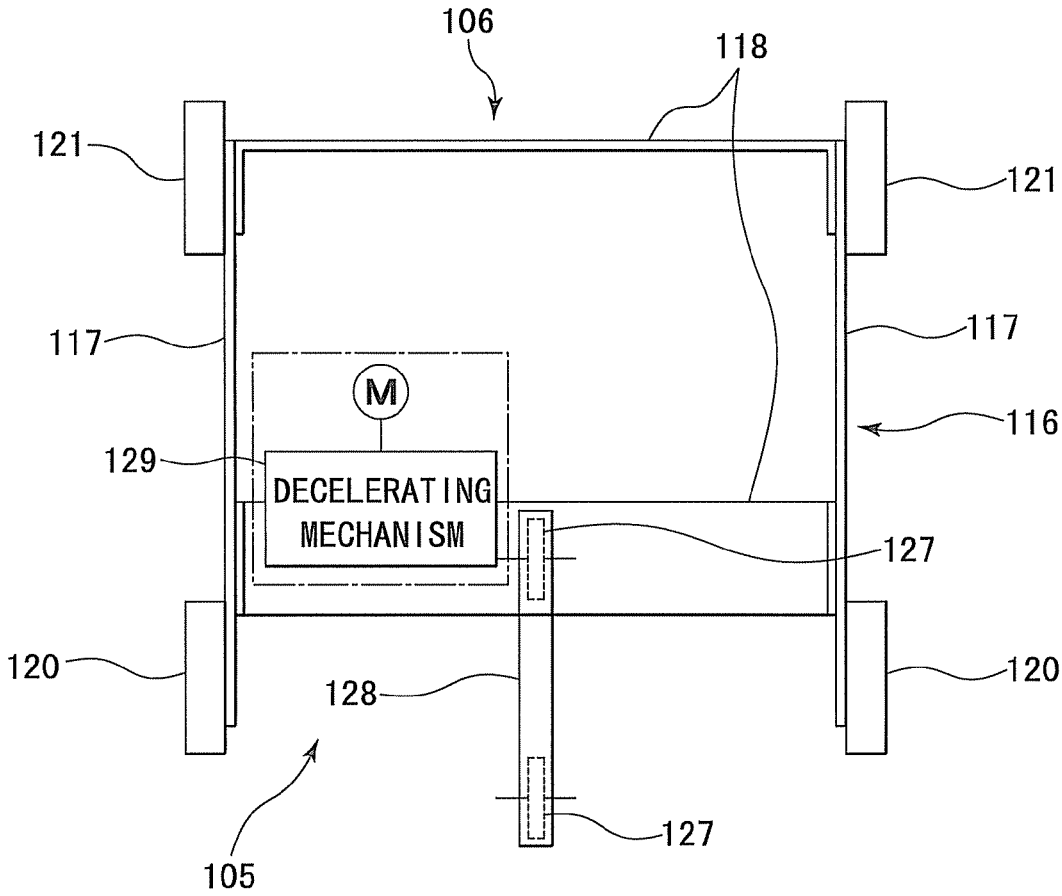
FIG. 9 is a front view of the driving unit shown in FIG. 8.

FIG. 9 is a front view of the driving unit 105 shown in FIG. 8. As shown in FIG. 9, the driving unit 105 includes a decelerating mechanism 129 that decelerates the rotation of the motor M and transmits the rotation to one toothed roller 127. The motor M and the decelerating mechanism 129 is attached to the side of the counter base 103 together with the rollers 127 and the timing belt 128 that configure the belt driving mechanism.

Figure 10:
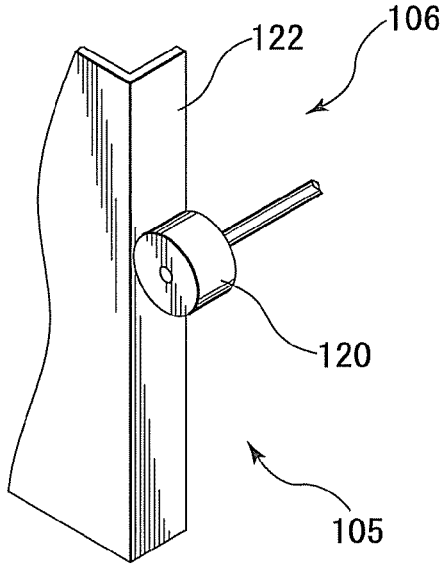
FIG. 10 is a perspective view of still another example of the driving unit that drives to raise and lower the basket placing table.

FIG. 10 is a perspective view of still another example of the driving unit 105 that drives to raise and lower the basket placing table 104. The example shown in FIG. 10 is a third example of the driving unit 105. In the third example, a frictional wheel mechanism having the motor M (see FIG. 11) as a driving source is used as the driving unit 105. The motor M drives to rotate the lower rollers 120 of the lower rollers 120 and the upper rollers 121 rotatably attached to the frame 116. The lower rollers 120 have frictional force between the lower rollers 120 and the rails 122. Therefore, when the lower rollers 120 are driven by the motor M to rotate, the lower rollers 120 do not slip with respect to the rails 122 and can raise and lower the basket placing table 104 integral with the frame 116.

Figure 11:
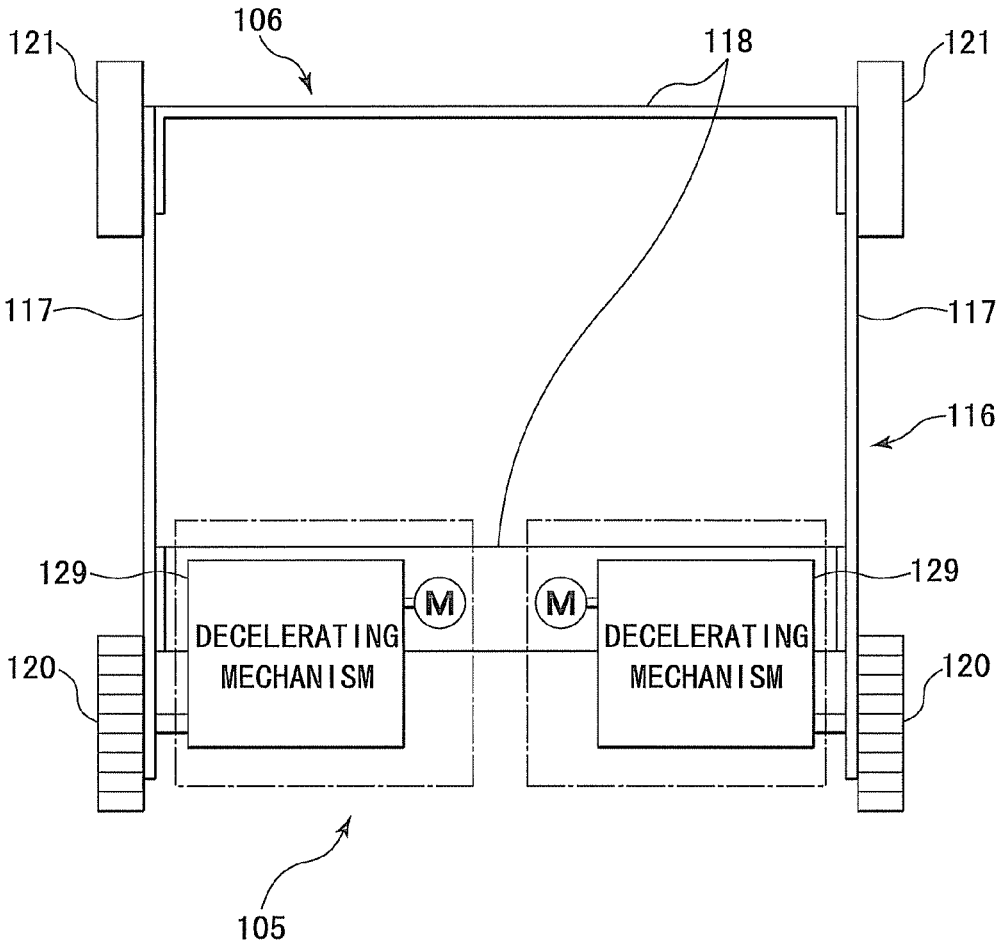
FIG. 11 is a front view of the driving unit shown in FIG. 10.

FIG. 11 is a front view of the driving unit 105 shown in FIG. 10. As shown in FIG. 11, the driving unit 105 includes decelerating mechanisms 129 that decelerate the rotation of the motor M and transmit the rotation to the lower rollers 120. The motor M and the decelerating mechanisms 129 are attached to the side of the frame 116 together with the lower rollers 120.

Figure 12:
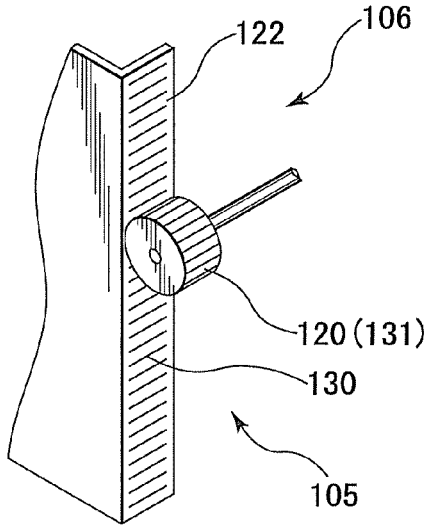
FIG. 12 is a perspective view of a modification of the driving unit shown in FIG. 10.

FIG. 12 is a perspective view of a modification of the driving unit 105 shown in FIG. 10. The frictional wheel mechanism shown in FIGS. 10 and 11 prevents, depending on friction between the rails 122 and the lower rollers 120, a slip of the lower rollers 120 with respect to the rails 122. On the other hand, in the example shown in FIG. 12, racks 130 are attached to the rails 122 and the lower rollers 120 are configured as pinion gears 131 that mesh with the racks 130. This makes it possible to prevent a slip of the lower rollers 120 with respect to the rails 122.

Figure 13:
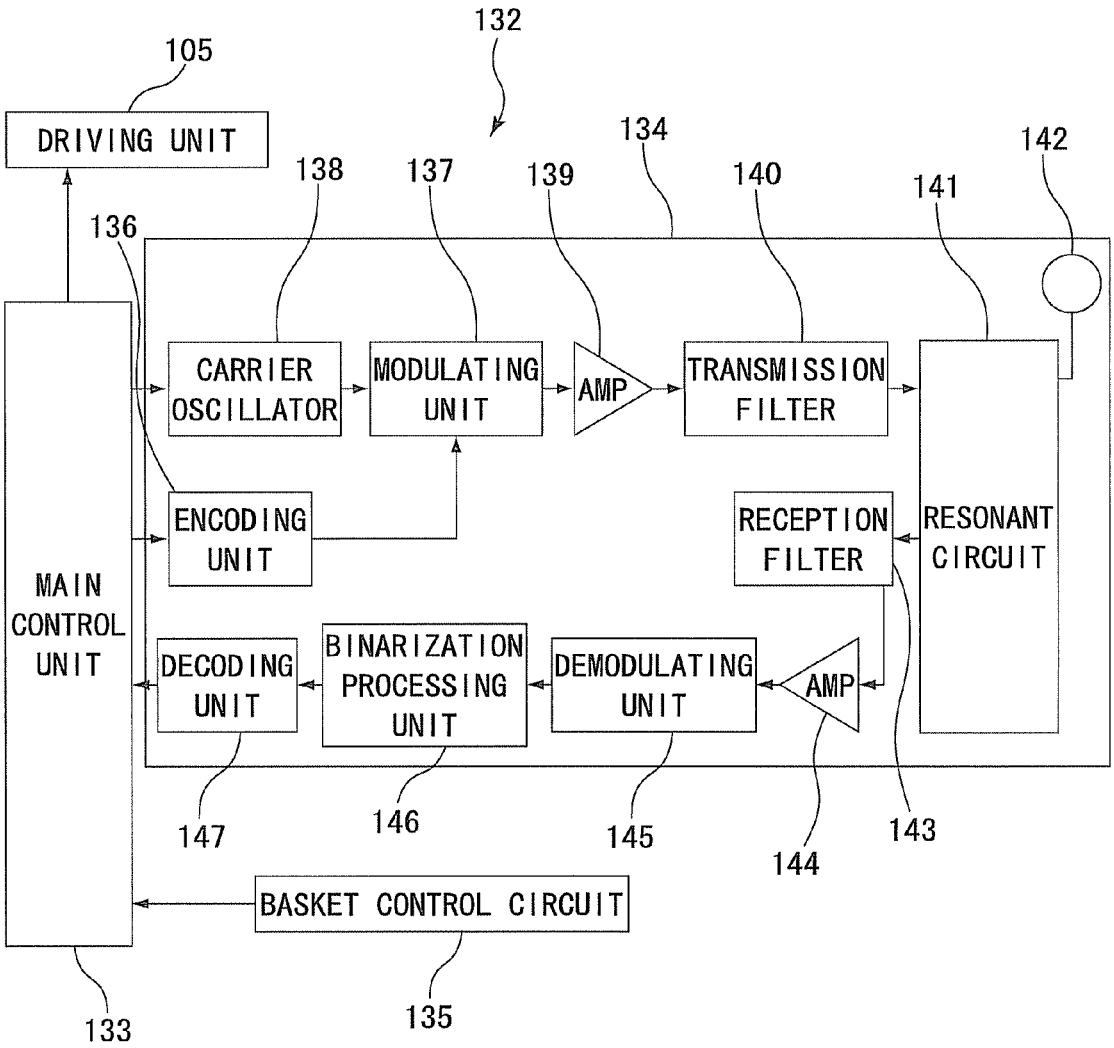
FIG. 13 is a block diagram of electric connection in a control unit.

FIG. 13 is a block diagram of electric connection in a control unit 132. The checkout counter 101 incorporates the control unit 132 that executes driving control and the like for the driving unit 105. The control unit 132 includes a main control unit 133 configured as a processor that sequentially executes various processes. The main control unit 133 is a digital circuit including an integrated circuit and executes sequential processing processes in order while temporarily storing temporary data and the like in a resist area (not shown in the figure). The driving unit 105, a near distance radio communication circuit 134 as a first detecting unit, and a basket sensing circuit 135 as a second detecting unit are connected to such a main control unit 133.

As explained with reference to FIG. 2, the checkout counter 101 detects that the shopping cart 151 enters the access area closer to the basket placing table 104 than the predetermined range. When the shopping cart 151 enters the access area, the checkout counter 101 retracts the basket placing table 104 to the lowered position LP. The rear distance radio communication circuit 134 as the first detecting unit is a circuit for detecting that the shopping cart 151 enters the access area. The near distance radio communication circuit 134 executes near distance radio communication by RFID (Radio Frequency Identification) with an IC chip 156 (see FIG. 2) for near distance radio provided on a side of the upper stage placing section 154 of the shopping cart 151. More specifically, when the IC chip 156 of the shopping cart 151 and the near distance radio communication circuit 134 become capable of performing near distance radio communication, the main control unit 133 determines that the shopping cart 151 enters the access area.

Details of the near distance radio communication circuit 134 are explained. The near distance radio communication circuit 134 encodes transmission data, which is transmitted from the main control unit 133 to the IC chip 156 of the shopping cart 151, with an encoding unit 136 and outputs the transmission data to a modulating unit 137. The modulating unit 137 outputs the transmission data, which is output from the encoding unit 136, as a modulation signal carried on a carrier wave output from a carrier oscillator 138. The carrier oscillator 138 generates, as an example, a carrier wave having a frequency of 13.56 MHz. An amplifier 139 amplifies a modulation signal output by the modulating unit 137. A transmission filter 140 applies necessary filtering to the amplified modulation signal and outputs the modulation signal to a resonant circuit 141. The resonant circuit 141 starts resonant operation based on the input signal and outputs a transmission signal from an antenna 142 as an electromagnetic wave.

As an example, the antenna 142 is arranged on a side of the basket placing table 104 and in a position facing the IC chip 156 provided in the shopping cart 151 that is brought close to the counter base 103 to be stopped along the same. When a customer brings the shopping cart 151 close to the basket placing table 104 in order to stop the shopping cart 151 along the counter base 103, the IC chip 156 is located near the antenna 142. Then, the near distance radio communication circuit 134 gives electromotive force to the IC chip 156 according to an electromagnetic induction action to enable the IC chip 156 and the main control unit 133 to communicate with each other. In the near distance radio communication circuit 134, a reception filter 143 is connected to an output side of the resonant circuit 141. The reception filter 143 filters a signal output by the IC chip 156 to which the electromotive force is given. An amplifier 144 amplifies the filtered signal output by the reception filter 143 and outputs the signal to a demodulating unit 145. The demodulating unit 145 demodulates the signal amplified by the amplifier 144 and outputs the signal to a binarization processing unit 146. The binarization processing unit 146 binarizes the signal demodulated by the demodulating unit 145 and outputs the signal to a decoding unit 147. The decoding unit 147 decodes the signal binarized by the demodulating unit 145 and outputs the signal to the main control unit 133. In this way, the near distance radio communication circuit 134 enables the IC chip 156 and the main control unit 133 to perform data communication. Therefore, as explained above, when the IC chip 156 of the shopping cart 151 and the near distance radio communication circuit 134 become capable of performing near distance radio communication, the main control unit 133 determines that the shopping cart 151 enters the access area.

As explained above with reference to FIG. 2, after retracting the basket placing table 104 to the lowered position LP, the checkout counter 101 detects presence or absence of the shopping cart 151 stopped along the counter base 103. When the shopping cart 151 stopped along the counter base 103 is not detected, the checkout counter 101 returns the basket placing table 104 to the raised position UP. The basket sensing circuit 135 as the second detecting unit is a circuit for detecting presence or absence of the shopping cart 151 stopped along the counter base 103. As such a basket sensing circuit 135, as an example, a reflective optical sensor circuit can be used. As another example, an infrared sensor circuit can be used. As still another example, an ultrasonic sensor can be used. In the basket sensing circuit 135, a sensing element 135*a* such as an optical sensor, an infrared sensor, or an ultrasonic sensor is arranged on the placing surface 104*a* of the basket placing table 104 (see FIG. 1).

As still another example, the near distance radio communication circuit 134 may also be used as the basket sensing circuit 135. In this case, the near distance radio communication circuit 134 caused to function as the first detecting unit performs, with the antenna 142 embedded in the side of the basket placing table 104, near distance radio communication with the IC chip 156 arranged on the side of the upper stage placing section 154 of the shopping cart 151. On the other hand, the near distance radio communication circuit 134 caused to function as the second detecting unit performs, with the antenna 142 embedded in the placing surface 104*a* of the basket placing table 104, near distance radio communication with the IC chip 156 arranged on the rear surface of the upper stage placing section 154 of the shopping cart 151. Such a system uses different ID codes for the IC chip 156 arranged on the side of the upper stage placing section 154 of the shopping cart 151 and the IC chip 156 arranged on the rear surface thereof. The main control unit 133 can distinguish and recognize, according to a type of the ID code of the detected IC chip 156, that the shopping cart 151 enters the access area and that the shopping cart 151 stopped along the counter base 103 is present.

Figure 14:
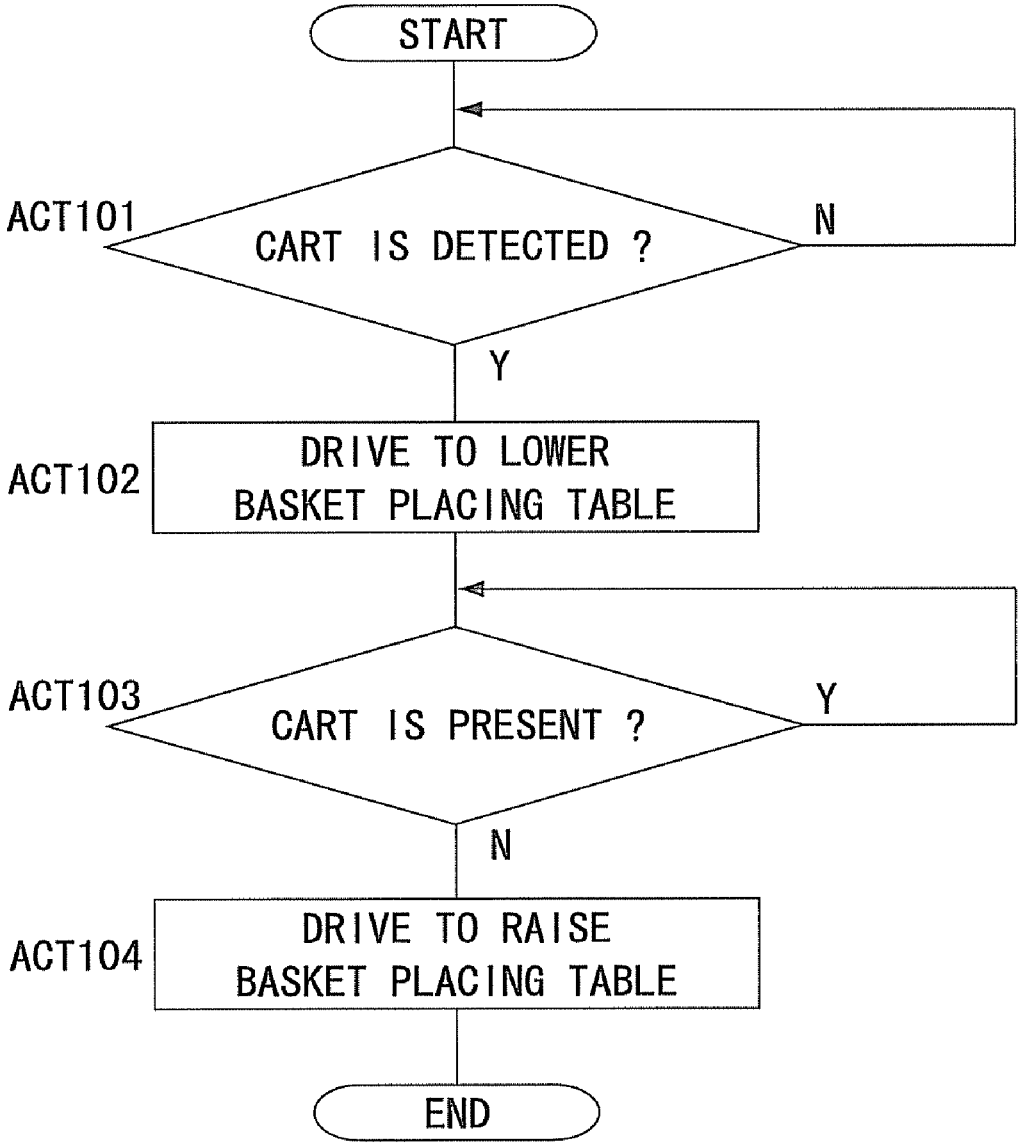
FIG. 14 is a flowchart of a processing process in a main control unit.

FIG. 14 is a flowchart of a processing process in the main control unit 133. When the near distance radio communication circuit 134 as the first detecting unit detects that the shopping cart 151 enters the access area (Y in ACT 101), the main control unit 133 controls to drive the driving unit 105 to lower the basket placing table 104 (ACT 102). When the basket placing table 104 is lowered to the lowered position LP, the shopping cart 151 can be stopped along the counter base 103. This state allows a store clerk to directly take out, without moving the shopping basket SB placed on the upper stage placing section 154 of the shopping cart 151, commodities (not shown in the figure) from the shopping basket SB. The store clerk holds a barcode (not shown in the figure) attached to a commodity taken out from the shopping basket SB in front of the scan window 110 of the barcode reader 109. The barcode reader 109 reads the barcode held in front of the scan window 110.

After locating the basket placing table 104 in the lowered position LP, the main control unit 133 determines, according to output from the basket sensing circuit 135 as the second detecting unit, presence or absence of the shopping cart 151 stopped along the counter base 103 (ACT 103). When the shopping cart 151 stopped along the counter base 103 is not detected (N in ACT 103), the main control unit 133 controls to drive the driving unit 105 to raise the basket placing table 104 (ACT 104). Consequently, the basket placing table 104 returns to the raised position UP. This state allows the store clerk to easily take out commodities (not shown in the figure) from the shopping basket SB placed on the placing surface 104*a* of the basket placing table 104.

Figure 15:
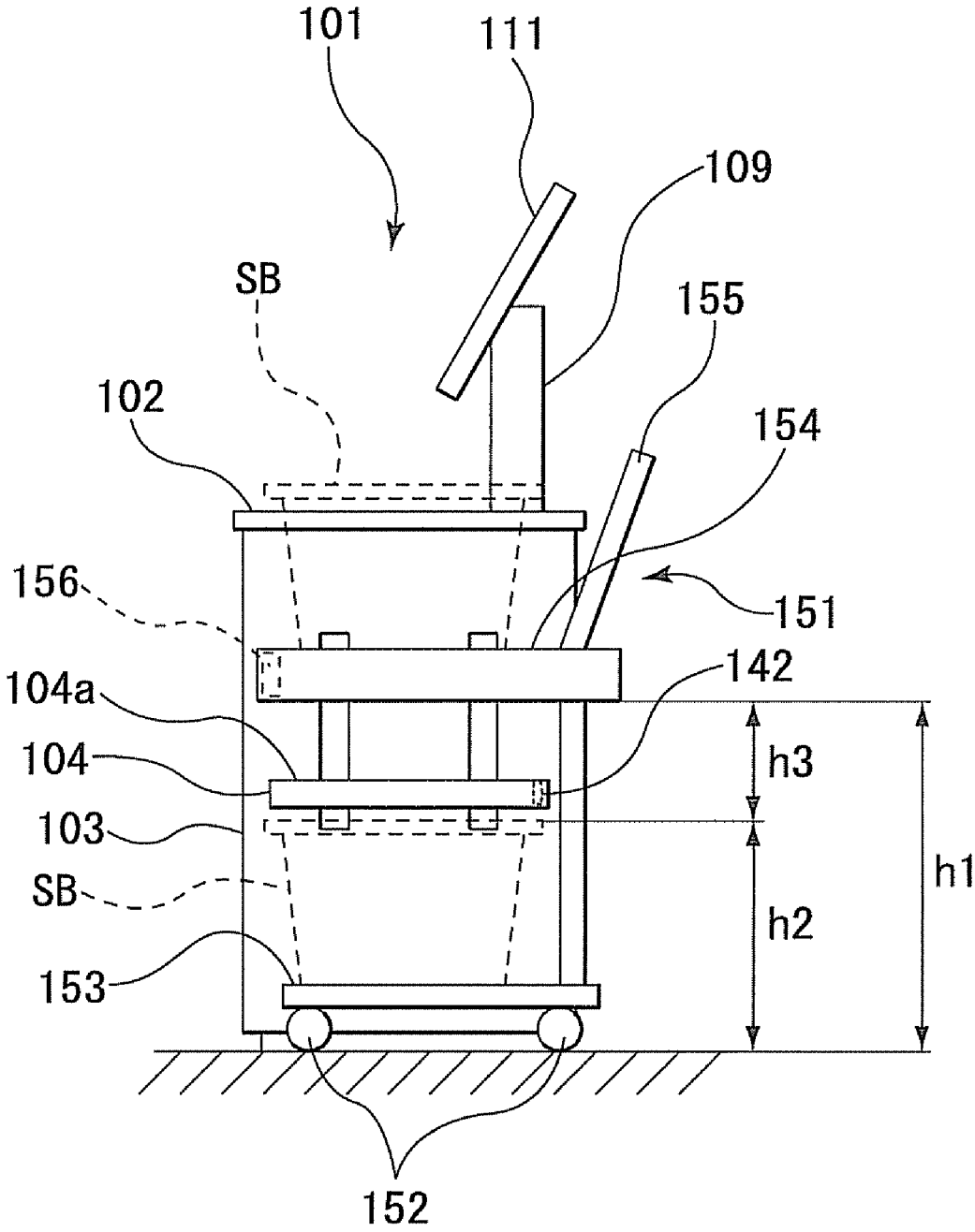
FIG. 15 is a schematic diagram for explaining a positional relation between units of the shopping cart and the basket placing table located in a lowered position in the checkout counter.

FIG. 15 is a schematic diagram for explaining a positional relation between the units of the shopping cart 151 and the basket placing table 104 located in the lowered position LP in the checkout counter 101. In a state in which the shopping cart 151 is stopped along the counter base 103, the height from the ground surface to the bottom of the upper stage placing section 154 of the shopping cart 151 is h1. When the shopping basket SB is placed on the lower stage placing section 153 of the shopping cart 151, the height from the ground surface to the top of the shopping basket SB is h2. Therefore, the checkout counter 101 sets the arrangement of the units such that the basket placing table 104 located in the lowered position LP is located in a range of height h3 obtained by deducting the height h2 from the height h1. Consequently, the basket placing table 104 is surely located in a position (the lowered position LP) where the basket placing table 104 does not interfere with the shopping cart 151 stopped along the counter base 103. Moreover, even if the shopping basket SB is placed on the lower stage placing section 153 of the shopping cart 151, the basket placing table 104 located in the lowered position LP does not interfere with the shopping basket SB placed on the lower stage placing section 153.

As explained above, the checkout counter 101 according to this embodiment can switch, without imposing a burden on a user and without depending on manual operation, a form of use for placing the shopping basket SB on the basket placing table 104 and a form of use for stopping the shopping cart 151 along the counter base 103. Therefore, it is possible to obtain extremely satisfactory workability.

Another embodiment of the present invention is explained with reference to FIGS. 16 to 18. Components same as those in the embodiment shown in FIGS. 1 to 15 are denoted by the same reference numerals and signs and explanation of the components is omitted.

Figure 16:
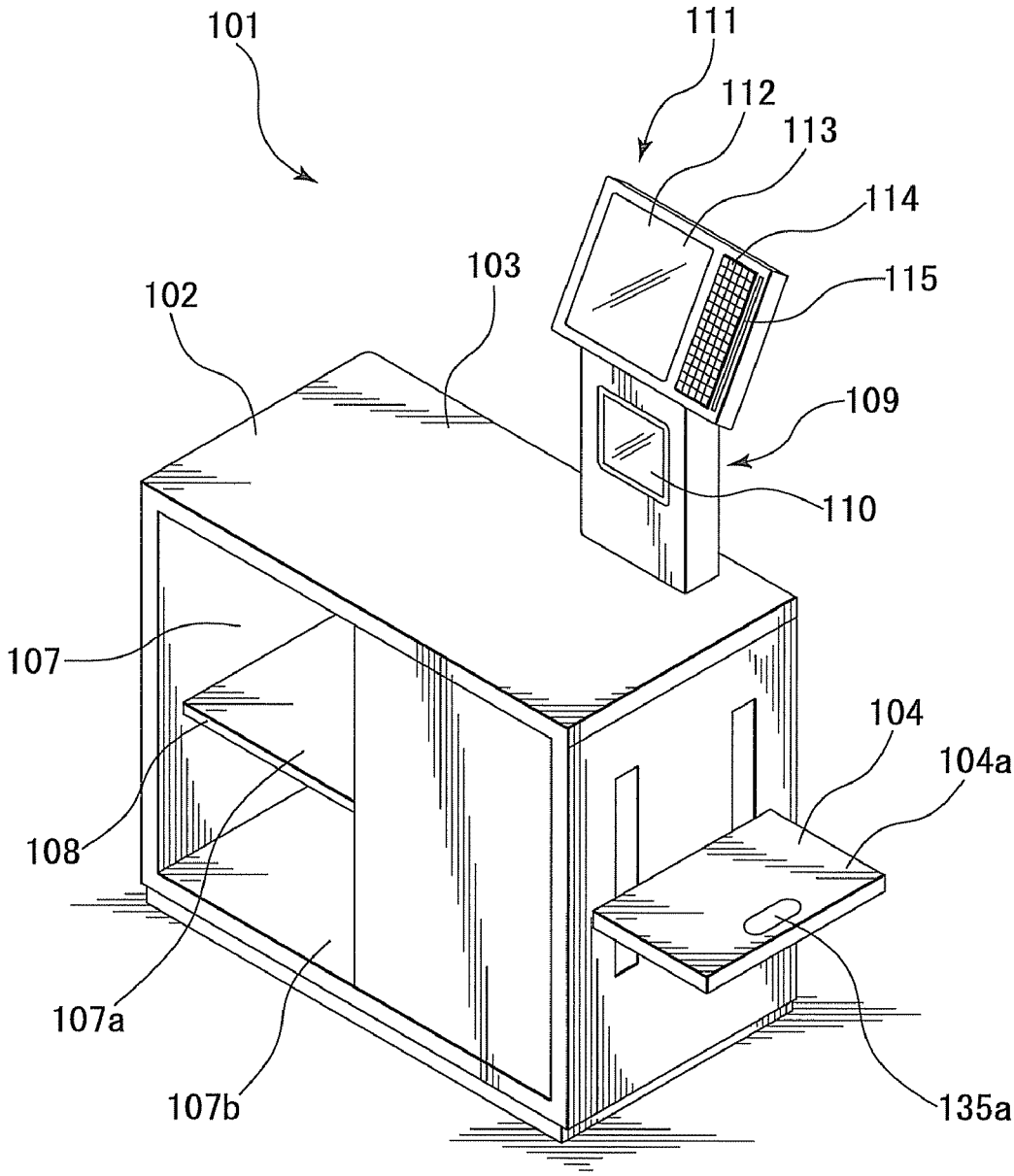
FIG. 16 is a perspective view of a checkout counter according to another embodiment of the present invention.

FIG. 16 is a perspective view of the checkout counter 101. As shown in FIG. 16, in a normal state, the checkout counter 101 according to this embodiment locates the basket placing table 104 in the lowered position LP. As explained above, this state prevents the shopping cart 151 stopped along the counter base 103 from interfering with the basket placing table 104. On the other hand, the basket sensing circuit 135 according to this embodiment functions as a placement detecting unit that detects that the shopping basket SB is placed on the placing surface 104*a* of the basket placing table 104. When the basket sensing circuit 135 detects that the shopping basket SB is placed on the placing surface 104*a* of the basket placing table 104, the control unit 132 drives the driving unit 105 such that the basket placing table 104 is located in the raised position UP. As explained above, the basket placing table 104 located in the raised position UP sets the upper surface of the shopping basket SB placed on the basket placing table 104 substantially the same as a height position of the counter top plate 102 of the counter base 103. Consequently, the checkout counter 101 can make it easy to take out commodities (not shown in the figure) from the shopping basket SB placed on the placing surface 104*a* of the basket placing table 104.

When the basket sensing circuit 135 detects that the shopping basket SB is removed from the placing surface 104*a* of the basket placing table 104, the control unit 132 drives the driving unit 105 to locate the basket placing table 104 in the lowered position LP again.

Figure 17:
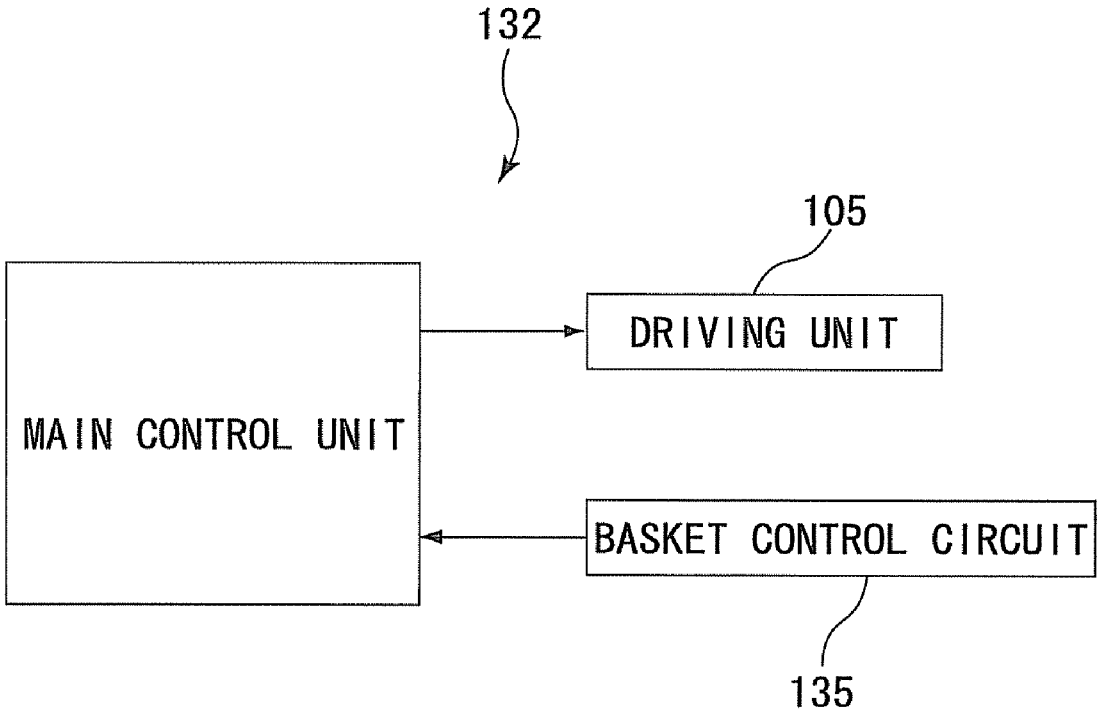
FIG. 17 is a block diagram of electric connection in a control unit.

FIG. 17 is a block diagram of electric connection in the control unit 132. In executing the operation explained above, the checkout counter 101 does not need the near distance radio communication circuit 134 of the control unit 132 according to the embodiment shown in FIGS. 1 to 15. Therefore, the control unit 132 according to this embodiment has a simple configuration in which only the driving unit 105 and the basket sensing circuit 135 are connected to the main control unit 133.

The basket sensing circuit 135 does not detect presence or absence of the shopping cart 151 stopped along the counter base 103. The basket sensing circuit 135 only has to be a sensing circuit that detects whether the shopping basket SB is placed on the placing surface 104*a* of the basket placing table 104. Therefore, besides the various kinds of sensing circuits cited as the examples of the basket sensing circuit 135 according to the embodiment shown in FIGS. 1 to 15, a pressure sensor circuit that detects the level of pressure applied to the placing surface 104*a* of the basket placing table 104 can also be used as the basket sensing circuit 135. In this case, a semiconductor pressure sensor may be directly arranged on the placing surface 104*a* of the basket placing table 104 or a pressure change in an air bag arranged on the placing surface 104*a* of the basket placing table 104 may be transmitted to a flange type pressure sensor.

Figure 18:
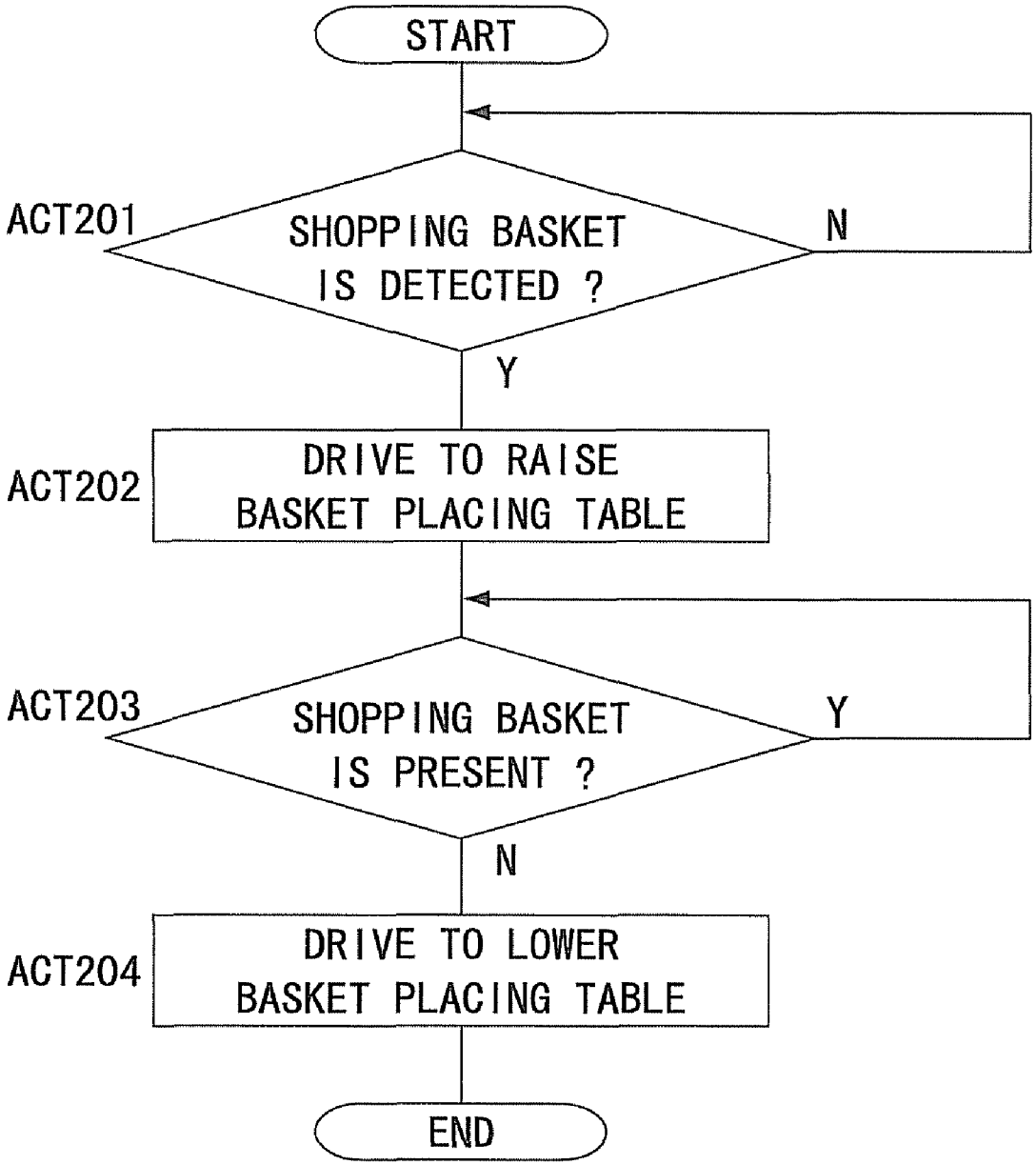
FIG. 18 is a flowchart of a processing process in a main control unit.

FIG. 18 is a flowchart of a processing process in the main control unit 133. When the basket sensing circuit 135 detects that the shopping basket SB is placed on the placing surface 104*a* of the basket placing table 104 (Y in ACT 201), the main control unit 133 controls to drive the driving unit 105 to locate the basket placing table 104 in the raised position UP (ACT 202). When the basket sensing circuit 135 detects that the shopping basket SB is removed from the placing surface 104*a* of the basket placing table 104 (N in ACT 203), the main control unit 133 controls to drive the driving unit 105 to return the basket placing table 104 to the lowered position LP (ACT 204).

As explained above, the checkout counter 101 according to this embodiment can switch, without imposing a burden on the user and without depending on manual operation, a form of use for placing the shopping basket SB on the basket placing table 104 and a form of use for stopping the shopping cart 151 along the counter base 103. Therefore, it is possible to obtain extremely satisfactory workability.

Still another embodiment of the present invention is explained with reference to FIG. 19. Components same as those in the embodiment shown in FIGS. 1 to 15 and the embodiment shown in FIGS. 16 to 18 are denoted by the same reference numerals and signs and explanation of the components is omitted. This embodiment is an example of application of the present invention to a self checkout terminal ST set in a checkout processing area.

Figure 19:
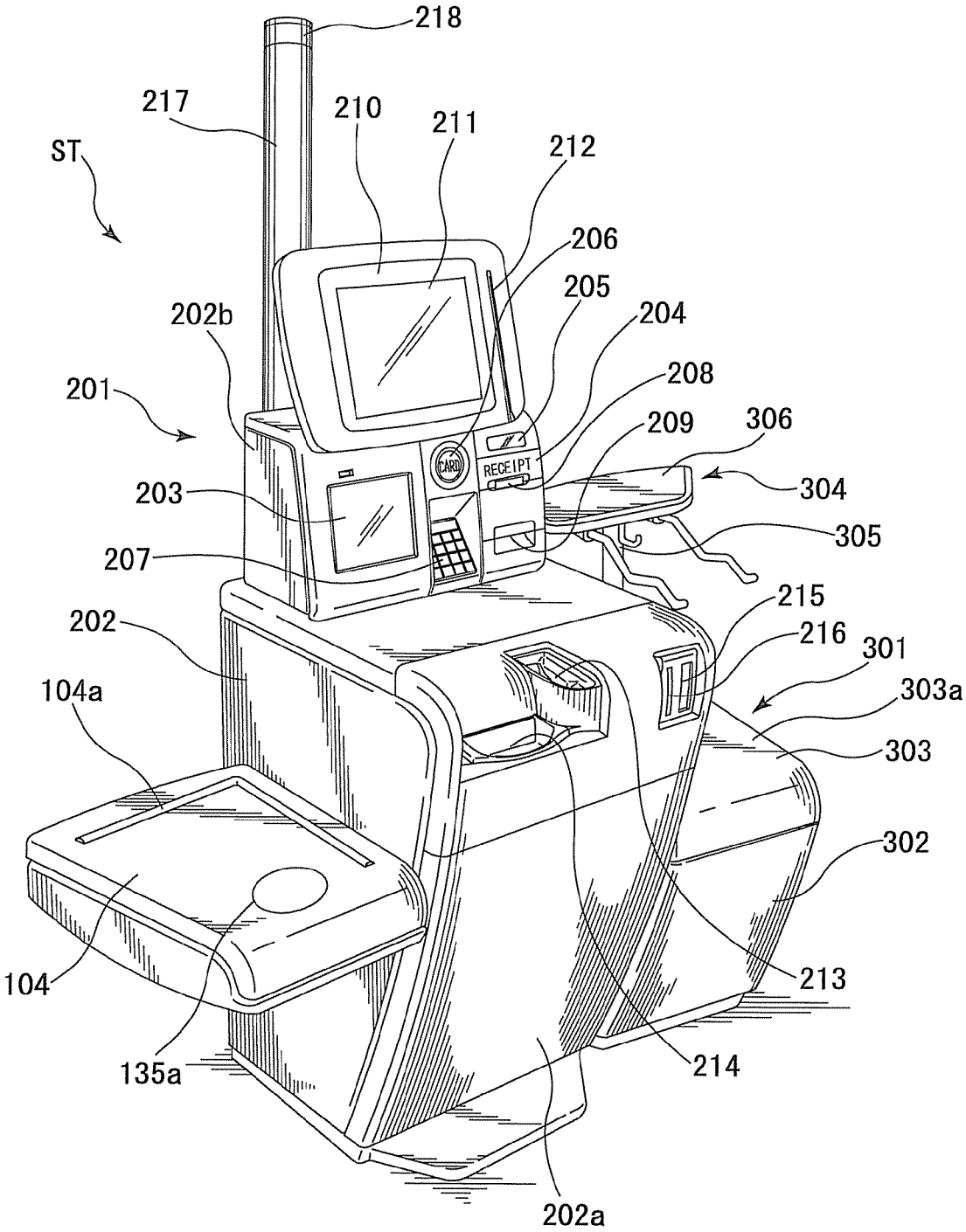
FIG. 19 is a perspective view of a self checkout terminal according to still another embodiment of the present invention.

FIG. 19 is a perspective view of the self checkout terminal ST. The self checkout terminal ST includes a settlement terminal 201 and a weighting device 301.

The settlement terminal 201 includes a housing 202, from the left side of which the basket placing table 104 for placing the shopping basket SB including commodities that a customer is about to purchase projects. The housing 202 of the settlement terminal 201 includes a base housing 202*a* set on a floor surface and a small upper housing 202*b* placed on an upper surface of the base housing 202*a*. A front surface of the base housing 202*a* inclines to narrow a projection area of the base housing 202*a* toward a lower part of thereof. Consequently, the base housing 202*a* has a shape offset further to an inner side toward the lower part thereof.

The upper housing 202*b* includes various user interfaces. In the upper housing 202*b*, a barcode reader 203 as a commodity-code reading unit is arranged on a left side, a printer cover 204 and a monitoring camera 205 are arranged on a right side, and a card reading unit 206 and a ten key 207 as a settlement unit are arranged between the barcode reader 203 on the left side and the printer cover 204 and the monitoring camera 205 on the right side. The barcode reader 203 is a vertical scanner functioning as a commodity-code reading unit that reads a commodity code attached to a commodity. The printer cover 204 includes a receipt issue port 208. The upper housing 202*b* incorporates a receipt printer (not shown in the figure) on an inner side of the printer cover 204. The receipt printer issues a printed receipt (not shown in the figure) from the receipt issue port 208. The printer cover 204 can freely open and close relative to the upper housing 202*b*. A flap 209 provided in an upper part of the printer cover 204 is a grip used to pull and remove the printer cover 204. The monitoring camera 205 is arranged above the printer cover 204. The card reading unit 206 establishes radio communication with a not-shown non-contact IC card and reads information from and write information in the non-contact IC card. As an example, the non-contact IC card can store electronic money having a value equivalent to cash. As another example, the non-contact IC card stores an identification number for identifying a debit bank account and is used in settlement. In FIG. 19, the upper housing 202*b* incorporates a not-shown antenna on an inner side of a portion marked "CARD" in a circle. The card reading unit 206 establishes radio communication with the non-contact IC card via an antenna. The ten key 207 is used for inputting an identification number in settlement by the non-contact IC card.

An LCD 210 as a display unit including a liquid crystal display panel is attached to the upper housing 202*b*. The LCD 210 includes a touch panel 211 as an input unit on a display surface thereof and includes a card reading groove 212 on a right side thereof. The LCD 210 incorporates a card reader writer (not shown in the figure) as a settlement unit in the inside of the card reading groove 212. The card reader writer reads information, for example, a card number and an identification number recorded in a magnetic card such as a credit card.

The base housing 202*a* incorporates a cash depositing and dispensing apparatus (not entirely shown in the figure) for coins and bills. As a part of the cash depositing and dispensing apparatus, in the base housing 202*a*, a coin depositing port 213 is arranged on an upper surface in the center thereof and a coin dispensing port 214 is arranged on a left side thereof. Further, in the base housing 202*a*, a bill depositing port 215 and a bill dispensing port 216 are arranged in a right upper position on a front surface thereof.

In the self checkout terminal ST, a display pole 217 as an informing unit that displays a present state of the self checkout terminal ST is vertically provided from a rear surface of the base housing 202*a*. The display pole 217 includes, at a distal end thereof, a light emitting unit 218 that selectively emits blue light and red light.

The weighting device 301 includes a scale pan 303 in an upper part of a scale housing 302. A bag holder 304 is attached to the scale pan 303. The scale pan 303 includes a placing table 303*a* on an upper surface thereof. The bag holder 304 is attached to the placing table 303*a*. Therefore, the scale pan 303 is used as a pedestal for the bag holder 304. An arm supporting unit 305 of a pole shape is vertically provided in the center behind the placing table 303*a*. A temporary placing table 306 for placing a commodity at an upper end thereof is fixed to the arm supporting unit 305. The temporary placing table 306 includes a flat surface on an upper surface thereof. The flat surface is used for temporarily placing a commodity after a barcode thereof is read by the barcode reader 203 of the settlement terminal 201. Both the placing table 303*a* and the temporary placing table 306 play a role of a placing unit for placing a commodity, a commodity code of which is input.

The self checkout terminal ST according to this embodiment includes the basket placing table 104 in the housing of the settlement terminal 201. The basket placing table 104 has the structure same as the basket placing table 104 explained in the embodiment shown in FIGS. 1 to 15 and the embodiment shown in FIGS. 16 to 18 and realizes the same actions and effects.

In the settlement terminal 201, as an example, as in the embodiment shown in FIGS. 1 to 15, in a normal state, the basket placing table 104 is located in the raised position UP. This state allows the store clerk to satisfactorily perform, when the shopping basket SB is placed on the placing surface 104*a* of the basket placing table 104, work for taking out commodities from the shopping basket SB and reading barcodes (not shown in the figure) with the barcode reader 203. On the other hand, when the customer attempts to stop the shopping cart 151 along the settlement terminal 201, the basket placing table 104 located in the raised position UP interferes with the upper stage placing section 154 of the shopping cart 151. Therefore, the control unit 132 of the settlement terminal 201 controls raising and lowering of the basket placing table 104 as in the embodiment shown in FIGS. 1 to 15.

In the settlement terminal 201, as another example, as in the embodiment shown in FIGS. 16 to 18, in a normal state, the basket placing table 104 is located in the lowered position LP. This state prevents interference between the shopping cart 151 and the basket placing table 104 when the customer stops the shopping cart 151 along the settlement terminal 201. On the other hand, when the basket sensing circuit 135 detects that the shopping basket SB is placed on the placing surface 104*a* of the basket placing table 104, the control unit 132 of the settlement terminal 201 drives the driving unit 105 to locate the basket placing table 104 in the raised position UP. As explained above, this state allows the store clerk to satisfactorily perform work for taking out commodities from the shopping basket SB placed on the placing surface 104*a* of the basket placing table 104 and reading barcodes (not shown in the figure) with the barcode reader 203. Control after that is performed as explained in the embodiment shown in FIGS. 16 to 18.

Obviously, numerous modifications and variations of the present invention are possible in light of the above teachings. It is therefore to be understood that within the scope of the appended claims, the invention may be practiced otherwise than as specifically described herein.

What is claimed is:

1. A checkout counter comprising:

a counter base for checkout;

a basket placing table that is provided on one side of the counter base, has on an upper surface thereof a placing surface for placing a shopping basket, and is freely raised and lowered between a raised position suitable for placing the shopping basket and a lowered position where the basket placing table does not interfere with a shopping cart stopped along one side of the counter base;

a driving unit that drives to raise and lower the basket placing table;

a first detecting unit that detects that the shopping cart enters an access area closer to the basket placing table than a predetermined range;

a second detecting unit that detects presence or absence of the shopping cart stopped along one side of the counter base; and a control unit that controls to drive, when the first detecting unit detects entrance of the shopping cart into the access area, the driving unit to move the basket placing table to the lowered position and, thereafter, controls to drive, when the second detecting unit does not detect the shopping cart stopped along the counter base, the driving unit to return the basket placing table to the raised position.

2. The checkout counter according to claim 1, wherein the lowered position where the basket placing table is located is a position where the basket placing table is located between a shopping basket placing section on an upper stage side of the shopping cart and the shopping basket placed on a shopping basket placing section on a lower stage side of the shopping cart.

3. The checkout counter according to claim 1, wherein the first detecting unit executes near distance radio communication with an IC chip for near distance radio communication is provided in the shopping cart via an antenna arranged on a side of the basket placing table and detects entrance of the shopping cart into the access area according to data from the IC chip obtained as a result of the near distance radio communication.

4. A checkout counter comprising:

a counter base for checkout;

a basket placing table that is provided on one side of the counter base, has on an upper surface thereof a placing surface for placing a shopping basket, and is freely raised and lowered between a raised position suitable for placing the shopping basket and a lowered position where the basket placing table does not interfere with a shopping cart stopped along one side of the counter base;

a driving unit that drives to raise and lower the basket placing table;

a placement detecting unit that detects that the shopping basket is placed on the placing surface of the basket placing table; and a control unit that controls to drive, when the placement detecting unit detects placement of the shopping basket on the placing surface, the driving unit to move the basket placing table to the raised position and, thereafter, drives to control, when the placement detecting unit does not detect the placement of the shopping basket on the placing surface, the driving unit to return the basket placing table to the lowered position.

5. The checkout counter according to claim 4, wherein the lowered position where the basket placing table is located is a position where the basket placing table is located between a shopping basket placing section on an upper stage side of the shopping cart and the shopping basket placed on a shopping basket placing section on a lower stage side of the shopping cart.

6. The checkout counter according to claim 4, wherein the placement detecting unit detects the placement of the shopping basket on the placing surface according to an output change of a pressure sensor that fluctuates when the shopping basket is placed on the placing surface.

7. A self checkout terminal comprising:

a terminal base that enables a customer to perform self checkout using a user interface provided in a housing and including a commodity-code reading unit, a display unit, an input unit, and a settlement unit;

a basket placing table that is provided on one side of the housing, has on an upper surface thereof a placing surface for placing a shopping basket, and is freely raised and lowered between a raised position suitable for placing the shopping basket and a lowered position where the basket placing table does not interfere with a shopping cart stopped along one side of the housing;

a driving unit that drives to raise and lower the basket placing table;

a first detecting unit that detects that the shopping cart enters an access area closer to the basket placing table than a predetermined range;

a second detecting unit that detects presence or absence of the shopping cart stopped along one side of the housing; and a control unit that controls to drive, when the first detecting unit detects entrance of the shopping cart into the access area, the driving unit to move the basket placing table to the lowered position and, thereafter, controls to drive, when the second detecting unit does not detect the shopping cart stopped along the housing, the driving unit to return the basket placing table to the raised position.

8. A self checkout terminal comprising:

a terminal base that enables a customer to perform self checkout using a user interface provided in a housing and including a commodity-code reading unit, a display unit, an input unit, and a settlement unit;

a basket placing table that is provided on one side of the housing, has on an upper surface thereof a placing surface for placing a shopping basket, and is freely raised and lowered between a raised position suitable for placing the shopping basket and a lowered position where the basket placing table does not interfere with a shopping cart stopped along one side of the housing;

a driving unit that drives to raise and lower the basket placing table;

a placement detecting unit that detects that the shopping basket is placed on the placing surface of the basket placing table; and a control unit that controls to drive, when the placement detecting unit detects placement of the shopping basket on the placing surface, the driving unit to move the basket placing table to the raised position and, thereafter, drives to control, when the placement detecting unit does not detect the placement of the shopping basket on the placing surface, the driving unit to return the basket placing table to the lowered position.

9. The checkout counter according to claim 1, wherein the control unit controls to drive, when the first detecting unit detects entrance of the shopping cart into the access area, the driving unit to move the basket placing table to the lowered position and, thereafter controls to drive, when the second detecting unit does not detect the shopping cart stopped along the counter base, the driving unit to return the basket placing table in a state that a shopping basket is not placed on the basket placing table to the raised position.

10. The checkout counter according to claim 4, wherein the control unit controls to drive, when the placement detecting unit detects placement of the shopping basket on the placing surface, the driving unit to move the basket placing table to the raised position and, thereafter, drives to control, when the placement detecting unit does not detect the placement of the shopping basket on the placing surface, the driving unit to return the basket placing table in a state that a shopping basket is not placed on the basket placing table to the lowered position.

11. The self checkout terminal according to claim 7, wherein the control unit controls to drive, when the first detecting unit detects entrance of the shopping cart into the access area, the driving unit to move the basket placing table to the lowered position and, thereafter, controls to drive, when the second detecting unit does not detect the shopping cart stopped along the housing, the driving unit to return the basket placing table in a state that a shopping basket is not placed on the basket placing table to the raised position.

12. The self checkout terminal according to claim 8, wherein the control unit controls to drive, when the placement detecting unit detects placement of the shopping basket on the placing surface, the driving unit to move the basket placing table to the raised position and, thereafter, drives to control, when the placement detecting unit does not detect the placement of the shopping basket on the placing surface, the driving unit to return the basket placing table in a state that a shopping basket is not placed on the basket placing table to the lowered position.

13. The checkout counter according to claim 1, wherein the basket placing table has the placing surface for placing the whole shopping basket.

14. The checkout counter according to claim 4, wherein the basket placing table has the placing surface for placing the whole shopping basket.

15. The self checkout terminal according to claim 7, wherein the basket placing table has the placing surface for placing the whole shopping basket.

16. The self checkout terminal according to claim 8, wherein the basket placing table has the placing surface for placing the whole shopping basket.

* * * * *